US008622450B1

(12) United States Patent
Mengel

(10) Patent No.: US 8,622,450 B1
(45) Date of Patent: Jan. 7, 2014

(54) CAM HOOK TRUSS LIFT SYSTEM

(71) Applicant: Carl Mengel, New Brighton, PA (US)

(72) Inventor: Carl Mengel, New Brighton, PA (US)

( * ) Notice: Subject to any disclaimer, the term of this patent is extended or adjusted under 35 U.S.C. 154(b) by 0 days.

(21) Appl. No.: 13/753,667

(22) Filed: Jan. 30, 2013

Related U.S. Application Data

(60) Provisional application No. 61/601,621, filed on Feb. 22, 2012.

(51) Int. Cl.
*B66C 1/34* (2006.01)

(52) U.S. Cl.
USPC ..... 294/82.2; 294/82.24

(58) Field of Classification Search
USPC ..... 294/82.2, 82.17, 82.18, 82.19, 82.22, 294/82.24, 82.31, 101; 24/599.5–599.6, 24/600.1
See application file for complete search history.

(56) References Cited

U.S. PATENT DOCUMENTS

| | | | | |
|---|---|---|---|---|
| 2,133,557 | A | 10/1938 | Mcneillie et al. | |
| 3,165,344 | A | 1/1965 | Holder et al. | |
| RE28,709 | E | 2/1976 | Crook, Jr. | |
| 4,240,658 | A | 12/1980 | Britson | |
| 4,427,228 | A * | 1/1984 | Mattila | 294/82.24 |
| 4,475,758 | A | 10/1984 | Paulsson | |
| 4,977,647 | A * | 12/1990 | Casebolt | 24/599.5 |
| 5,178,427 | A | 1/1993 | Jorritsma | |
| 6,450,558 | B1 * | 9/2002 | Ringrose | 294/82.2 |
| 7,059,644 | B2 * | 6/2006 | Neufeldt | 294/82.24 |
| 7,422,257 | B2 * | 9/2008 | Neufeldt | 294/82.24 |

* cited by examiner

*Primary Examiner* — Stephen Vu
(74) *Attorney, Agent, or Firm* — RG Patent Consulting, LLC; Rachel Gilboy

(57) ABSTRACT

An apparatus for efficiently lifting heavy trusses used in constructing buildings requiring a pitched roof. The use of this apparatus reduces the manpower requirement for constructing roofs by providing a J-shape cam-hook-lift-apparatus to latch onto a truss and use the power of a lifting mechanism, such as a crane, to raise and place the roof trusses into a predetermined position. Using this apparatus will reduce the amount of time needed to complete a roof assembly and increase safety for workers.

19 Claims, 5 Drawing Sheets

CAM HOOK TRUSS LIFT SYSTEM

CROSS-REFERENCE TO RELATED APPLICATION

The present applications are related to and claims priority from prior provisional application Ser. Nos. 61/601,621 filed Feb. 22, 2012 which applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of truss lifting devices and more specifically relates to a cam hook truss lift system for lifting and positioning building trusses into position.

2. Description of the Related A

When constructing a building with a pitched roof design it is typically necessary to use trusses. Trusses are generally composed of triangles because of the structural stability of that shape and design; thus providing a pitch to shed precipitation. A triangle is the simplest geometric figure that will not change shape when the lengths of the sides are fixed. A series of triangles are assembled together forming a desired length for the roof of the building under construction. Trusses are normally pre-assembled to the specified length and delivered to the construction site and must be put in place by on-site workers.

Typically a roofing crew waits in position for the trusses to be lifted up to them so they can place them and attached them according to specifications. However, trusses are typically long and cumbersome to handle making it difficult and dangerous to hoist the truss to the workers on the roof level and then put them in place. Many times workers need to climb ladders or scaffolding in a coordinated fashion while carrying the truss to reach the roof level resulting in potential injuries to the workers and possible damage to the truss if it is dropped. Several workers are often required to work together to hoist the trusses to the roof level. Sometimes it is necessary to pull workers from other disciplines working on the building, such as electricians and plumbers, in order to have enough manpower to lift the trusses to the required height. When this happens, the work that is abandoned to help with the trusses may fall behind schedule resulting in other problems with completing the overall project. It is desirable to have a safe and convenience means by which trusses can be lifted and placed during construction.

Various attempts have been made to solve the above-mentioned problems such as those found in U.S. Pat. No. 4,240,658 to Britson; U.S. Pat. No. 5,178,427 to Jorritsma; U.S. Pat. No. 3,165,344 to Holder; U.S. Pat. No. 4,475,758 to Paulsson; U.S. Pat. No. 2,133,557 to McNeillie et al; and RE28709 to Crook. This prior art is representative of devices to lift trusses. None of the above inventions and patents, taken either singly or in combination, is seen to describe the invention as claimed.

Ideally, a cam hook truss lift system should provide a quick and an easy-to-use device to lift and place building trusses, and yet, would operate reliably and be manufactured at a modest expense. Thus, a need exists for a reliable cam hook truss lift system to avoid the above-mentioned problems.

BRIEF SUMMARY OF THE INVENTION

In view of the foregoing disadvantages inherent in the known truss lifting devices art, the present invention provides a novel cam hook truss lift system. The general purpose of the present invention, which will be described subsequently in greater detail, is to provide a device used to lift and place (wood or other) trusses into a roof assembly in an efficient manner utilizing fewer workers than required when manpower is used to remove trusses from a carrier device and then manually raise the trusses up to the roof level.

A cam hook truss lift system is disclosed herein, in a preferred embodiment, comprising a cam-hook-lift-apparatus comprised preferably of ferrous metal which, in turn, comprises two generally J-shaped-hooks arranged in parallel fashion offset from each other. The two generally J-shaped-hooks comprise a bottom-base-side, an open-top-end, a lifting-attachment side having a lifting lug with an aperture and a fastening system. The fastening system of the two generally J-shaped-hooks comprises at least one spring, a cam, a cam stopper, and a release member. The two generally J-shaped-hooks further comprise a restraint-side, a first offset spacer, a second offset spacer, a third offset spacer, and a fourth offset spacer.

The two generally J-shaped-hooks are arranged in an affixed parallel fashion via an offset using a first offset spacer, a second offset spacer, a third offset spacer, and a fourth offset spacer. The two generally J-shaped-hooks are preferably weld-affixed together by the first offset spacer, the second offset spacer, the third offset spacer, and the fourth offset spacer, each adjacent an outer edge of the two generally J-shaped-hooks. The two generally J-shaped-hooks comprise in combination a bottom-base-side, an open-top-end, a lifting-attachment side, and a restraint-side.

The lifting-attachment side comprises in combination a lifting lug and a fastening system. The lifting-attachment side comprises a width sufficient to house the fastening system, with the width being sufficiently equal to an offset provided by the first offset spacer, the second offset spacer, the third offset spacer, and the fourth offset spacer. The lifting-attachment side is longer in length than the restraint-side to form a J-shape of the two generally J-shaped-hooks. The restraint-side of the two generally J-shaped-hooks is connected via the bottom-base-side to the lifting-attachment side. The lifting lug of the lifting-attachment side comprises a solid mass (less an aperture for hooking thereto) and is located on a plane above a top-end of the restraint-side.

The fastening system of the lifting-attachment side of the two generally J-shaped-hooks comprises in combination at least one spring, a cam, a cam stopper, and a release member. The fastening system may be secured in place inside the lifting-attachment side by a plurality of fastener-bolt assemblies with the fastener-bolt assemblies comprising at least nuts and bolts. Other fastening means may be used. The (at least one) spring of the fastening system is used to tensionably-manipulate the cam between a released position and a held position with the cam being manipulated via the release member (and/or tension in the spring). The cam stopper defines a travel distance between a released position and a held position as at least one spring; the spring preferably comprising a coil-spring, is able to tension and compress.

The cam of the fastening system of the lifting-attachment side of the two generally J-shaped hooks comprises a cylindrical-channel by which the release member passes therethrough. The release member is held in position via a terminal end, with the terminal end being attached to the spring. The cam further comprises a lobed end and a non-lobed end in preferred embodiments. The cam stopper of the fastening system of the lifting-attachment side of the two generally J-shaped-hooks comprises a through-bolt. The release member of the fastening system of the lifting-attachment side of the two generally J-shaped-hooks comprises a terminal end and a proximate end and the terminal end comprises a through-hole by which the spring is able to be attached to the release member. The release member, comprising a rope (cable or the like), is not used to secure a truss in position.

The first offset spacer, the second offset spacer, the third offset spacer, and the fourth offset spacer each comprise a spacer-gusset. Together they have less weight than a solid construction, which is preferable during use, yet provide required strength to prevent deformation.

To operate the cam hook truss lift system a cable from a lifting machine is able to be connected to the cam-hook-lift-apparatus at the lifting lug using an aperture. A truss when to be lifted enters into (is placed into) the open-top-end of the cam-hook-lift-apparatus and is held in stasis against the restraint-side and the bottom-base-side via tension provided by the fastening system. The truss is able to be remotely released via the release member with the release member acting upon the cam and the spring of the fastening system thereby allowing the cam to be moved away from and out of contact with the truss. The cam-hook-lift-apparatus of the cam hook truss lift system is useful for remotely lifting, placing and releasing a truss into a user-defined position for forming a roof. The cam-hook-lift-apparatus is used in conjunction with a lifting machine, the lifting machine normally comprising a crane.

The present invention holds significant improvements and serves as a cam hook truss lift system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, cam hook truss lift system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a device to lift trusses and more particularly to a cam hook truss lift system as used to improve the procedure of lifting and placing heavy roof trusses to a building's roof area under construction.

Generally speaking, the cam hook truss lift system provides an apparatus for efficiently and safely lifting heavy trusses used in constructing buildings requiring a pitched roof. The use of this apparatus reduces the manpower requirement for constructing roofs by providing a J-shape cam-hook-lift-apparatus to latch onto a truss and use the power of a lifting mechanism, such as a crane, to raise and place the roof trusses into a predetermined position. Using this apparatus will reduce the amount of time and manpower needed to complete a roof assembly and allow specialists such as electricians and plumbers to continue performing their tasks rather than being reassigned to provide manpower in lifting trusses to the roof level.

Figure 1:
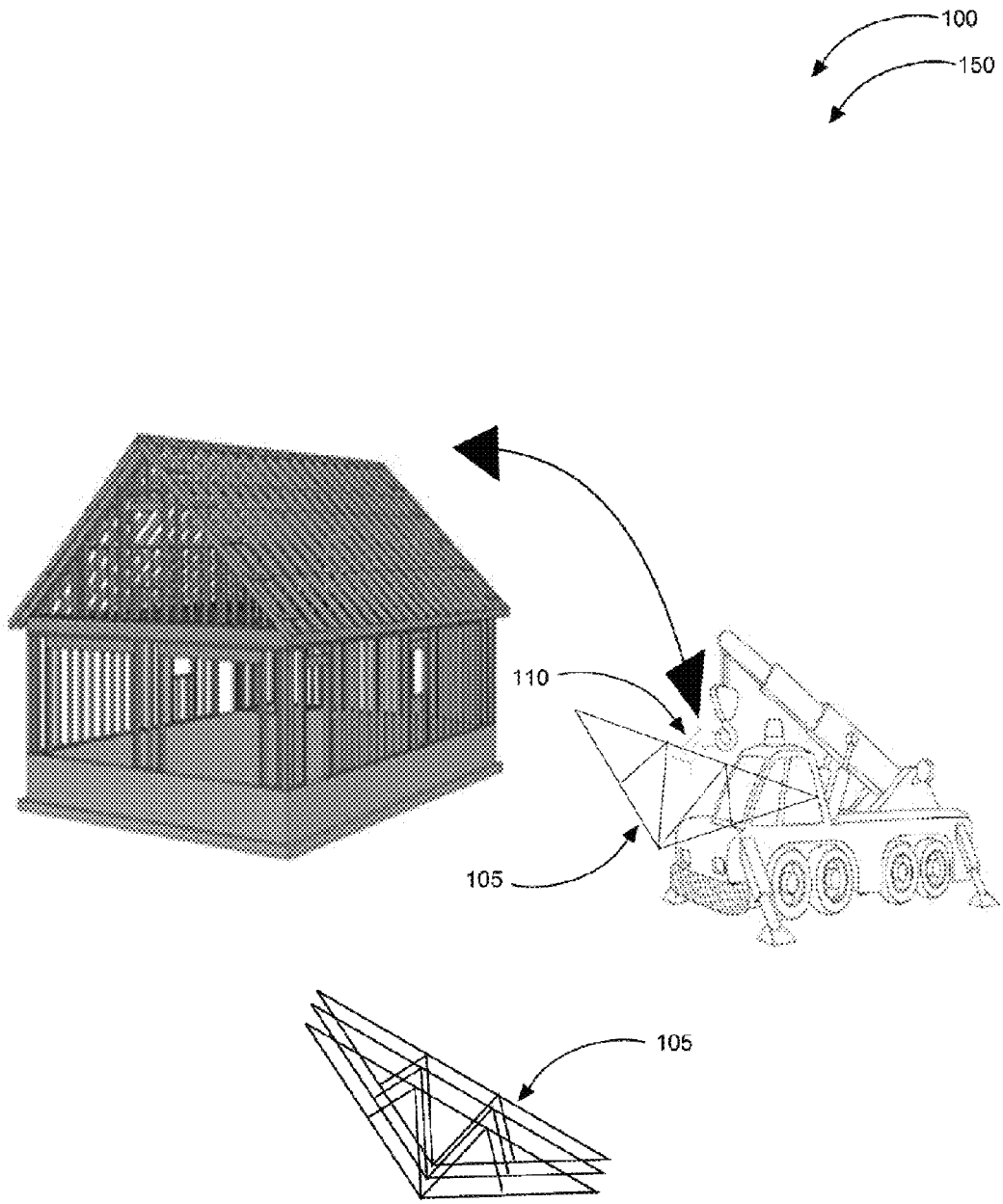
FIG. 1 shows a perspective view illustrating cam hook truss lift system in an in-use condition, according to an embodiment of the present invention.

Referring now to the drawings by numerals of reference there is shown in FIG. 1, a perspective view illustrating cam hook truss lift system 100 in an in-use 150 condition, according to an embodiment of the present invention.

Cam hook truss lift system 100 comprises cam-hook-lift-apparatus 110; cam-hook-lift-apparatus 110 preferably comprising pair of generally J-shaped-hooks 120 arranged in parallel fashion offset from each other including bottom-base-side 125, open-top-end 130, lifting-attachment side 140, restraint-side 160, first offset spacer 165, second offset spacer 170, third offset spacer 175, and fourth offset spacer 180. Cam-hook-lift-apparatus 110 comprises ferrous metal in preferred embodiments.

Lifting-attachment side 140 of cam-hook-lift-apparatus 110 comprises lifting lug 142 with aperture 143 and fastening system 145 having at least one spring 146, cam 147, cam stopper 148, and release member 149 comprising a rope or other such pulling means. In an alternate embodiment, release member 149 comprises a cable. At least one spring 146 comprises a coil-spring able to tension and compress repeatedly as needed. Lifting lug 142 comprises a solid mass about aperture 143. Cam stopper 148 comprises a bolt in preferred embodiments.

A cable from a lifting machine is able to be connected to cam-hook-lift-apparatus 110 at lifting lug 142 using aperture 143. Truss 105, when being lifted, is placed and enters into open-top-end 130 of cam-hook-lift-apparatus 110 and is held in stasis against restraint-side 160 and bottom-base-side 125 via tension provided by fastening system 145. When placed in position truss 105, is able to be remotely released via release member 149, with release member 149 acting upon cam 147 and at least one spring 146 of fastening system 145 thereby allowing cam 147 to be moved away from and out of contact with truss 105. Cam-hook-lift-apparatus 110 of cam hook truss lift system 100 is useful for remotely lifting, placing and releasing truss 105 into a user-defined position. Cam-hook-lift-apparatus 100 is useful for lifting large trusses 105 into position for forming a roof when used in conjunction with a lifting machine comprising a crane.

Figure 2:
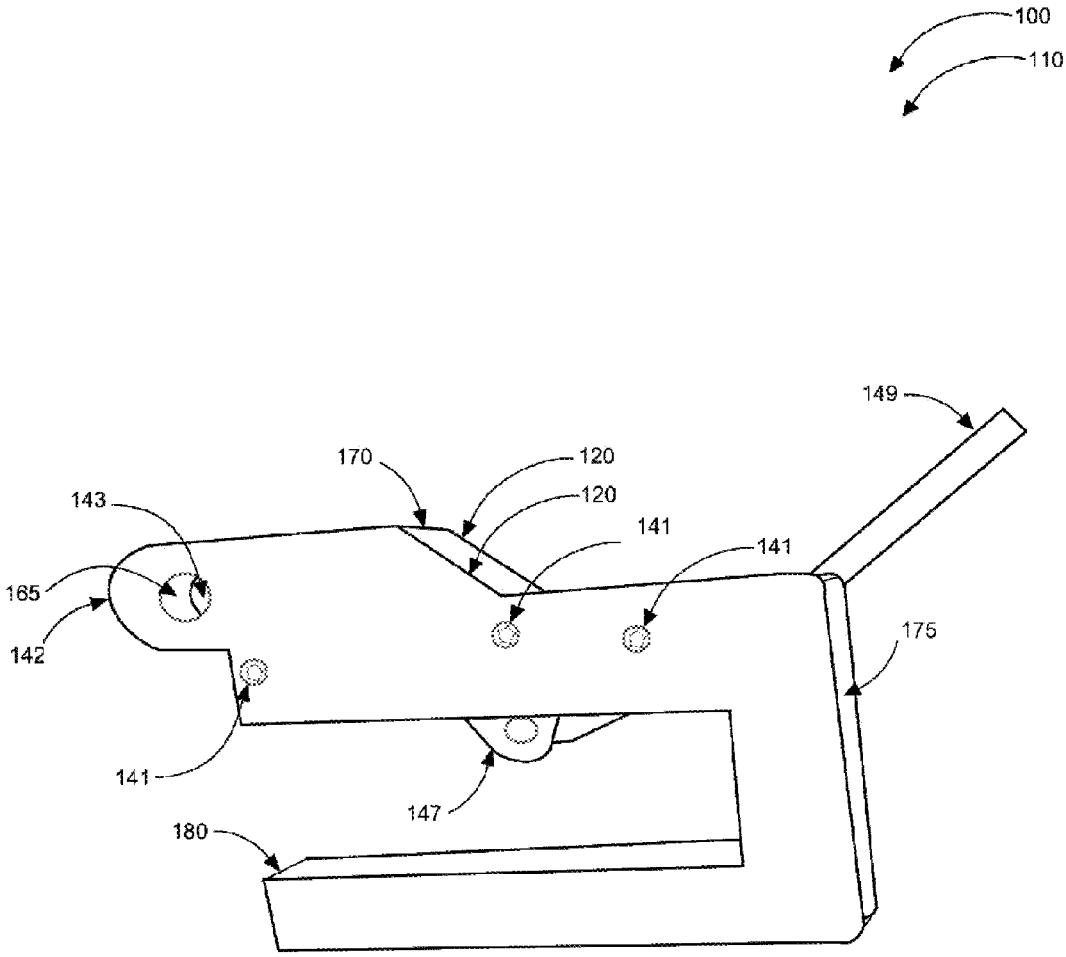
FIG. 2 is a side perspective view illustrating a cam-hook-lift-apparatus according to an embodiment of the present invention of FIG. 1.

Referring now to FIG. 2, a perspective side view illustrating cam-hook-lift-apparatus 110 according to an embodiment of the present invention of FIG. 1.

Pair of generally J-shaped-hooks 120 comprises in combination bottom-base-side 125, open-top-end 130, lifting-attachment side 140, and restraint-side 160, as previously mentioned. Pair of generally J-shaped-hooks 120 are arranged in parallel fashion via an offset using first offset spacer 165, second offset spacer 170, third offset spacer 175, and fourth offset spacer 180. Pair of generally J-shaped-hooks 120 are affixed together by first offset spacer 165, second offset spacer 170, third offset spacer 175, and fourth offset spacer 180 adjacent an outer edge of J-shaped-hooks 120. Each of first offset spacer 165, second offset spacer 170, third offset spacer 175, and fourth offset spacer 180, comprise a spacer-gusset able to maintain the desired offset (spacing).

Fastening system 145 of lifting-attachment side 140 of pair of generally J-shaped-hooks 120 is preferably held in place inside lifting-attachment side 140 by a plurality of fastener-bolt assemblies 141. Various fastening means may be used, provided they are reliable and durable in use. Lifting-attachment side 140 is longer in length than restraint-side 160 to form a J-shape of pair of generally J-shaped-hooks 120 as restraint-side 160 is connected via bottom-base-side 125 to lifting-attachment side 140 (forming the J-shape). Lifting lug 142 is located on a plane above a top-end of restraint-side 160 thereby providing a balanced-lift (over that of a U-shape or C-shape). First offset spacer 165, second offset spacer 170, third offset spacer 175, and fourth offset spacer 180 comprise less weight than a solid construction, rendering cam-hook-lift-apparatus 110 light-weight yet providing required strength to prevent deformation.

Figure 3:
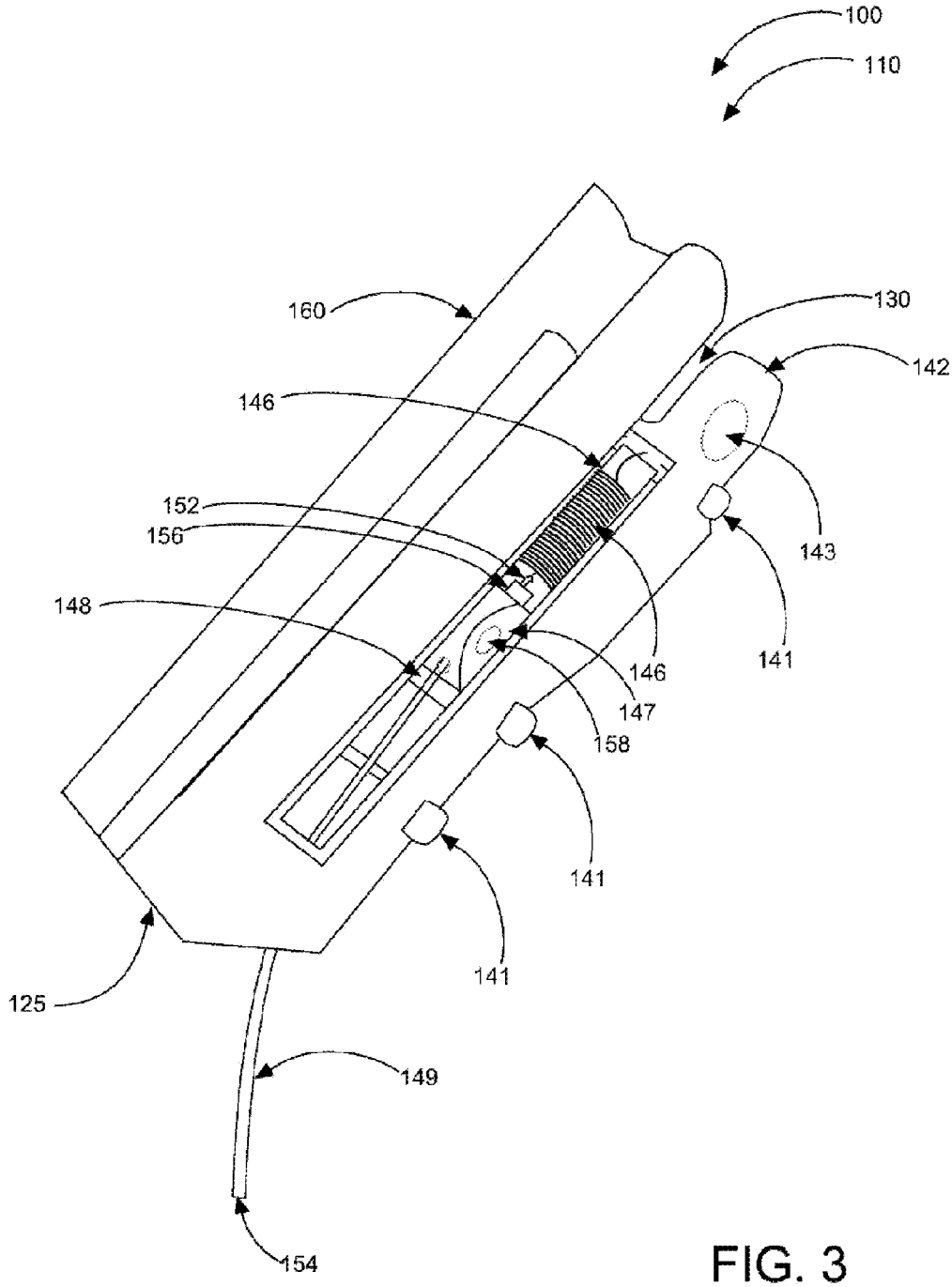
FIG. 3 is an offset perspective view illustrating the cam-hook-lift-apparatus according to an embodiment of the present invention of FIG. 1.

Referring now to FIG. 3, a perspective view illustrating cam-hook-lift-apparatus 110 according to an embodiment of the present invention of FIG. 1.

Release member 149 comprises terminal end 152 and proximate end 154. Terminal end 152 comprises through-hole 156 by which at least one spring 146 is able to be attached to release member 149, with proximate end 154 to be manipulated by a user. Release member 149 is held in position via terminal end 152, with terminal end 152 attached to at least one spring 120 through through-hole 156. Release member 149 is not used to secure truss 105 in position, but as a release means, as previously mentioned. Cam 147, in preferred embodiments comprises a lobed end and a non-lobed end. Cam 147 comprises cylindrical-channel 158 by which release member 149 passes therethrough.

Figure 4:
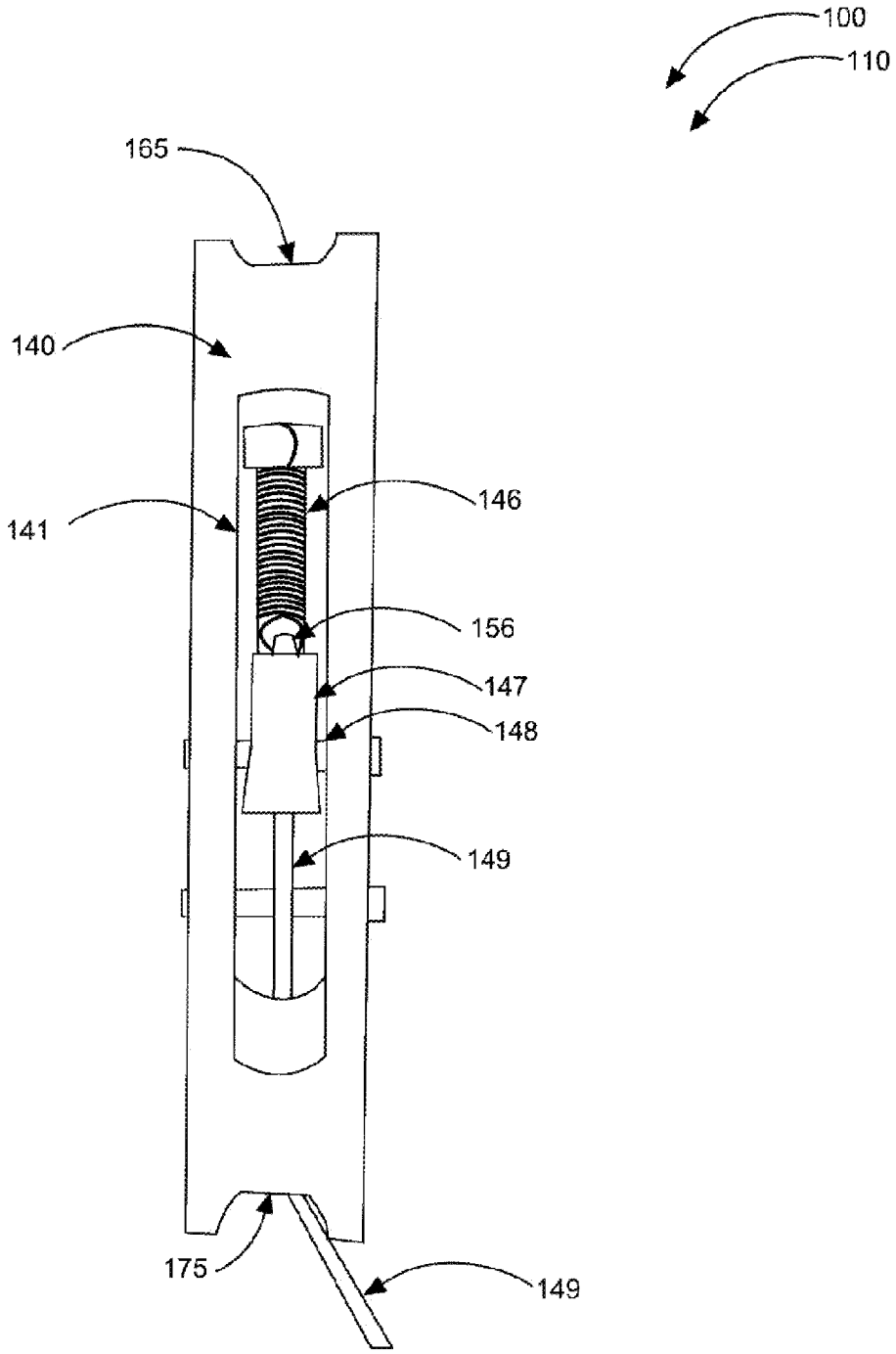
FIG. 4 is a bottom perspective view illustrating the cam-hook-lift-apparatus according to an embodiment of the present invention of FIG. 1.

Referring now to FIG. 4, a bottom perspective view illustrating a cam-hook-lift-apparatus 110 according to an embodiment of the present invention of FIG. 1.

Lifting-attachment side 140 comprises a width sufficient to house fastening system 145, with the width being sufficiently equal to an offset provided by first offset spacer 165, second offset spacer 170, third offset spacer 175, and fourth offset spacer 180. Fastening system 145 comprises in combination at least one spring 146, cam 147, cam stopper 148, and release member 149, as previously mentioned, these components substantially held within confines of lifting-attachment side 140. Spring 146 is used to tensionably-manipulate cam 147 between a released position and a held position. Cam 147 is also manipulated via release member 149 (over-coming spring-pressure), with cam stopper 148 defining a travel distance between a released position and a held position.

Figure 5:
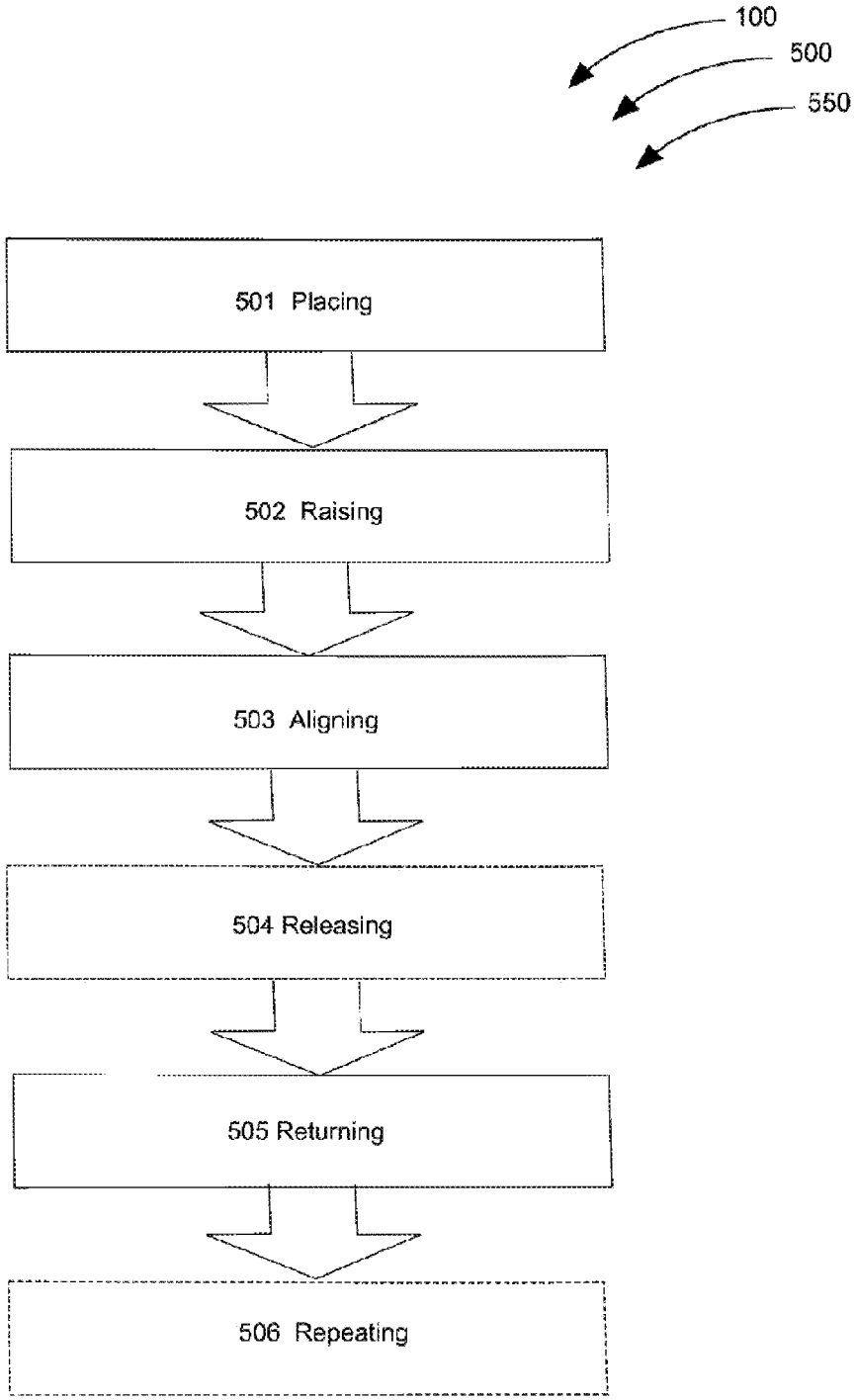
FIG. 5 is a flowchart illustrating a method of use of the cam hook truss lift system according to an embodiment of the present invention of FIGS. 1-4.

Referring now to FIG. 5, a flowchart 550 illustrating a method of use 500 of cam hook truss lift system 100 according to an embodiment of the present invention of FIGS. 1-4.

A method of use 500 for cam hook truss lift system 100 preferably comprises the steps of: step one 501 placing truss 105 inside cam-hook-lift-apparatus 110; step two 502 raising truss 105 to a roof level of a building; step three 503 aligning truss 105 into position for securement to a roof; step four 504 releasing truss 105 from cam-hook-lift-apparatus 110 via an operator pulling on release member 149; step five 505 returning cam-hook-lift-apparatus 110 to couple with and lift additional trusses 105 needed for a roof; and step six 506 repeating steps as often as required to raise all trusses 105 to roof level.

It should be noted that step 506 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. The cam hook truss lift system comprising:
- a cam-hook-lift-apparatus comprising;
  - a pair of generally J-shaped-hooks arranged in parallel fashion offset from each other including;
    - a bottom-base-side;
    - an open-top-end;
    - a lifting-attachment side comprising;
      - a lifting lug with an aperture;
      - a fastening system comprising;
        - at least one spring;
        - a cam;
        - a cam stopper; and
        - a release member;
    - a restraint-side;
    - a first offset spacer;
    - a second offset spacer;
    - a third offset spacer; and
    - a fourth offset spacer;

wherein said pair of generally J-shaped-hooks are arranged in said parallel fashion via said offset using said first offset spacer, said second offset spacer, said third offset spacer, said fourth offset spacer;

wherein said pair of generally J-shaped-hooks comprises in combination said bottom-base-side, said open-top-end, said lifting-attachment side, said restraint-side;

wherein said lifting-attachment side comprises in combination said lifting lug and said fastening system;

wherein said lifting-attachment side comprises a width sufficient to house said fastening system, said width sufficient equal to said offset provided by said first offset spacer, said second offset spacer, said third offset spacer, said fourth offset spacer;

wherein said fastening system comprises in combination said at least one spring, said cam, said cam stopper, and said release member;

wherein said at least one spring is used to tensionably-manipulate said cam between a released position and a held position, said cam also manipulated via said release member, said cam stopper defining a travel distance between said released position and said held position;

wherein a cable from a lifting machine is able to be connected to said cam-hook-lift-apparatus at said lifting lug using said aperture;

wherein a truss when being lifted enters into said open-top-end of said cam-hook-lift-apparatus and is held in stasis against said restraint-side and said bottom-base-side via tension provided by said fastening system;

wherein said truss is able to be remotely released via said release member, said release member acting upon said cam and said at least one spring of said fastening system thereby allowing said cam to be moved away from and out of contact with said truss; and wherein said cam-hook-lift-apparatus of said cam hook truss lift system is useful for remotely lifting, placing and releasing said truss into a user-defined positioning.

2. The cam hook truss lift system of claim 1 wherein said pair of generally J-shaped-hooks are affixed together by said first offset spacer, said second offset spacer, said third offset spacer, said fourth offset spacer adjacent an outer edge of said J-shaped-hooks.

3. The cam hook truss lift system of claim 2 wherein said at least one spring comprises a coil-spring able to tension and compress repeatedly as needed.

4. The cam hook truss lift system of claim 2 wherein said lifting lug comprises a solid mass about said aperture.

5. The cam hook truss lift system of claim 4 wherein said lifting-attachment side is longer in length than said restraint-side to form a J-shape of said pair of generally J-shaped-hooks as said restraint-side is connected via said bottom-base-side to said lifting-attachment side.

6. The cam hook truss lift system of claim 5 wherein said lifting lug is located on a plane above a top-end of said restraint-side thereby providing a balanced-lift.

7. The cam hook truss lift system of claim 2 wherein said cam stopper comprises a bolt.

8. The cam hook truss lift system of claim 2 wherein said first offset spacer, said second offset spacer, said third offset spacer, and said fourth offset spacer, each comprise a spacer-gusset.

9. The cam hook truss lift system of claim 8 wherein said first offset spacer, said second offset spacer, said third offset spacer, and said fourth offset spacer comprise less weight than a solid construction, rendering said cam-hook-lift-apparatus light-weight yet providing required strength to prevent deformation.

10. The cam hook truss lift system of claim 1 wherein said release member comprises a terminal end and a proximate end, wherein said terminal end comprises a through-hole by which said at least one spring is able to be attached to said release member, said proximate end to be manipulated by a user.

11. The cam hook truss lift system of claim 10 wherein said cam comprises a cylindrical-channel by which said release member passes therethrough, said release member held in position via said terminal end, said terminal end attached to said at least one spring through said through-hole.

12. The cam hook truss lift system of claim 1 wherein said release member comprises a rope.

13. The cam hook truss lift system of claim 1 wherein said release member comprises a cable.

14. The cam hook truss lift system of claim 1 wherein said fastening system of said lifting-attachment side of said pair of generally J-shaped-hooks is held in place inside said lifting-attachment side by a plurality of fastener-bolt assemblies.

15. The cam hook truss lift system of claim 1 wherein said cam-hook-lift-apparatus comprises metal.

16. The cam hook truss lift system of claim 1 wherein said release member is not used to secure said truss in position, but as a release means.

17. The cam hook truss lift system of claim 1 wherein said cam comprises a lobed end and a non-lobed end.

18. The cam hook truss lift system of claim 1 wherein said cam-hook-lift-apparatus is useful for lifting large wood said trusses into position for forming a roof when used in conjunction with said lifting machine, said lifting machine comprising a crane.

19. A cam hook truss lift system comprising:

a cam-hook-lift-apparatus comprising;

two generally J-shaped-hooks arranged in parallel fashion offset from each other including;

a bottom-base-side;

an open-top-end;

a lifting-attachment side comprising;

a lifting lug with an aperture;

a fastening system comprising;

at least one spring;

a cam;

a cam stopper; and a release member;

a restraint-side;

a first offset spacer;

a second offset spacer;

a third offset spacer; and a fourth offset spacer;

wherein said cam-hook-lift-apparatus comprises metal;

wherein said two generally J-shaped-hooks are arranged in said parallel fashion via said offset using said first offset spacer, said second offset spacer, said third offset spacer, said fourth offset spacer;

wherein said two generally J-shaped-hooks are weld-affixed together by said first offset spacer, said second offset spacer, said third offset spacer, said fourth offset spacer, each adjacent an outer edge of said two generally J-shaped-hooks;

wherein said two generally J-shaped-hooks comprise in combination said bottom-base-side, said open-top-end, said lifting-attachment side, said restraint-side;

wherein said lifting-attachment side comprises in combination said lifting lug and said fastening system;

wherein said lifting-attachment side comprises a width sufficient to house said fastening system, said width sufficient equal to said offset provided by said first offset spacer, said second offset spacer, said third offset spacer, said fourth offset spacer;

wherein said lifting-attachment side is longer in length than said restraint-side to form a J-shape of said two generally J-shaped-hooks, said restraint-side connected via said bottom-base-side to said lifting-attachment side;

wherein said lifting lug comprises a solid mass less said aperture;

wherein said lifting lug is located on a plane above a top-end of said restraint-side;

wherein said fastening system comprises in combination said at least one spring, said cam, said cam stopper, and said release member;

wherein said fastening system of said lifting-attachment side of said two generally J-shaped-hooks is secured in place inside said lifting-attachment side by a plurality of fastener-bolt assemblies, said fastener-bolt assemblies comprising at least nuts and bolts;

wherein said at least one spring is used to tensionably-manipulate said cam between a released position and a held position, said cam manipulated via said release member, said cam stopper defining a travel distance between said released position and said held position;

wherein said at least one spring comprises a coil-spring able to tension and compress;

wherein said cam comprises a cylindrical-channel by which said release member passes therethrough, said release member held in position via a terminal end, said terminal end attached to said at least one spring;

wherein said cam comprises a lobed end and a non-lobed end;

wherein said cam stopper comprises a through-bolt;

wherein said release member comprises said terminal end and a proximate end, wherein said terminal end comprises a through-hole by which said at least one spring is able to be attached to said release member;

wherein said release member is not used to secure said truss in position;

wherein said release member comprises a rope;

wherein said first offset spacer, said second offset spacer, said third offset spacer, and said fourth offset spacer, each comprise a spacer-gusset;

wherein said first offset spacer, said second offset spacer, said third offset spacer, and said fourth offset spacer comprise less weight than a solid construction, yet provide required strength to prevent deformation;

wherein a cable from a lifting machine is able to be connected to said cam-hook-lift-apparatus at said lifting lug using said aperture;

wherein a truss when lifted enters into said open-top-end of said cam-hook-lift-apparatus and is held in stasis against said restraint-side and said bottom-base-side via tension provided by said fastening system;

wherein said truss is able to be remotely released via said release member, said release member acting upon said cam and said at least one spring of said fastening system thereby allowing said cam to be moved away from and out of contact with said truss;

wherein said cam-hook-lift-apparatus of said cam hook truss lift system is useful for remotely lifting, placing and releasing said truss into a user-defined positioning; and wherein said cam-hook-lift-apparatus is useful for lifting large wood said trusses into position for forming a roof when used in conjunction with said lifting machine, said lifting machine comprising a crane.

* * * * *